United States Patent [19]

Scott

[11] 4,129,675

[45] Dec. 12, 1978

[54] PRODUCT COMPRISING BLEND OF HOLLOW POLYESTER FIBER AND CRIMPED POLYESTER BINDER FIBER

[75] Inventor: Paul T. Scott, Kinston, N.C.

[73] Assignee: E. I. Du Pont de Nemours and Company, Wilmington, Del.

[21] Appl. No.: 860,601

[22] Filed: Dec. 14, 1977

[51] Int. Cl.[2] ..... D04H 1/58

[52] U.S. Cl. ..... 428/288; 2/81; 2/94; 156/272; 428/296; 428/297; 428/303; 428/369; 428/398

[58] Field of Search ..... 428/288, 296, 297, 303, 428/369, 398; 2/81, 94; 156/272

[56] References Cited

U.S. PATENT DOCUMENTS

| | | | |
|---|---|---|---|
| 3,271,189 | 9/1966 | Hoffman | 428/369 |
| 3,740,282 | 6/1973 | Watson | 428/126 |
| 3,772,137 | 11/1973 | Tolliver | 428/398 |
| 3,905,057 | 9/1975 | Willis et al. | 428/369 |
| 4,068,036 | 1/1978 | Stanistreet | 428/369 |

*Primary Examiner*—James J. Bell

[57] ABSTRACT

Blends of 55 to 97% by weight crimped hollow polyester fiber having a void content of from 8 to 30% by volume and 3 to 45% by weight of crimped lower-melting polyester binder fiber impart advantageous properties to bonded low density batts made therefrom, such as high filling power but low load bulk which makes the batt particularly useful as fiberfill for garments.

4 Claims, 3 Drawing Figures

FIG. 1
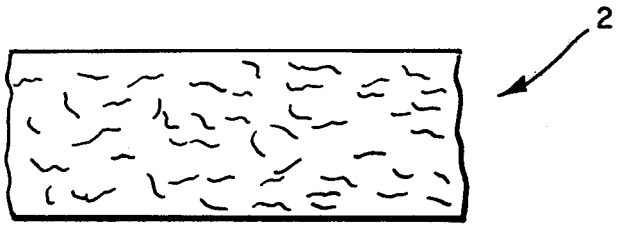
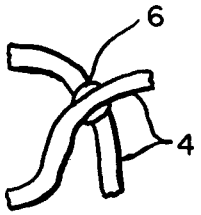
FIG. 2
FIG. 3
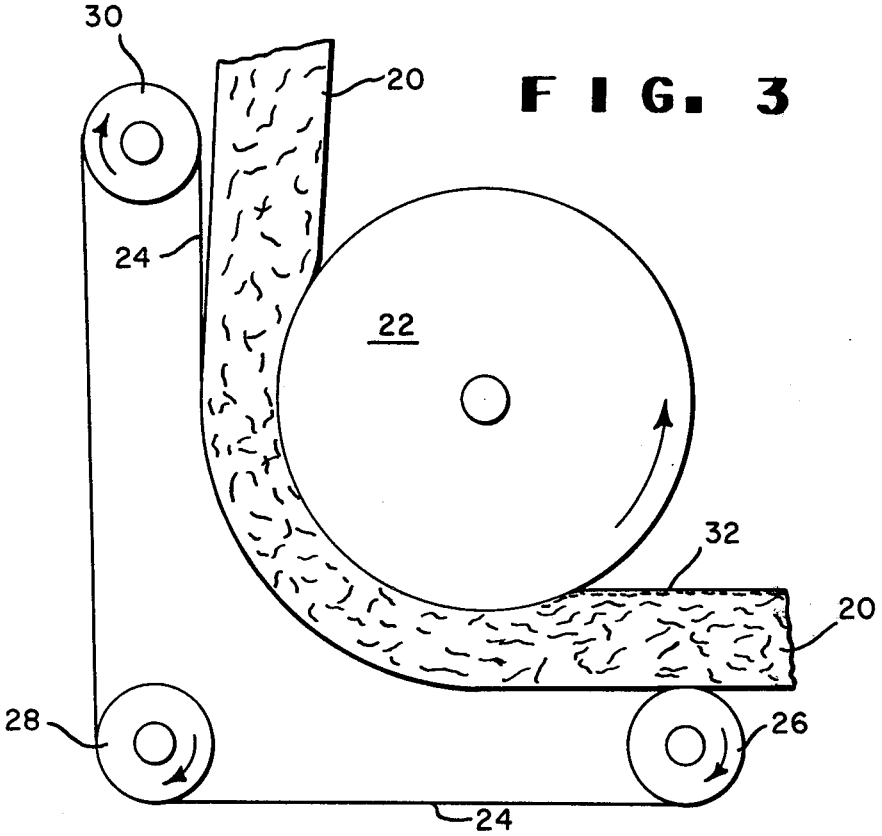

PRODUCT COMPRISING BLEND OF HOLLOW POLYESTER FIBER AND CRIMPED POLYESTER BINDER FIBER

BACKGROUND OF THE INVENTION

This invention is directed to fiber blends useful as a fiberfill especially in garments.

U.S. Pat. No. 3,772,137 discloses a batt of crimped hollow polyester fibers to have greater filling power (no-load bulk) and bulk under load than when made from solid polyester fibers.

Research Disclosure Journal (September 1975) Article No. 13717 discloses batts of polyester fiber and a specific low shrinkage binder fiber, poly(ethylene terephthalate/isophthalate), to provide improved stability and handling characteristics for the batt. The use of binder fiber was heretofore applied only to batt of solid polyester fiber because heating the batt to effect bonding between fibers caused the batt to lose filling power, which would be contrary to the reason for using hollow fiber in the first place. For this reason, the batt of hollow fiber was supported by a separate nonwoven fabric to improve the handling of the batt.

The need still existed for batt of both high filling power and improved handling and also for elimination of the expense of the separate fabric support. In the case of the garment fiberfill utility in particular, it was also desired that the batt exhibit low bulk under load so as to give garment containing the batt as fiberfill greater flexibility. For example, at the elbow location of a sleeve, the batt should collapse with as little load as possible to increase the freedom of movement of the arm of the wearer of the garment.

SUMMARY OF THE INVENTION

The present invention satisfies this need by providing a fiberfill blend of from 55 to 97% by weight of crimped hollow polyester fiber having a void content of from 8 to 30% volume and, complementally to total 100%, 3 to 45% by weight of crimped binder fibers of lower melting polyester than solid hollow polyester fiber. The utility of the blend is to form a batt and the binder fiber of the blend is present to bond the hollow fibers together. Upon application of heat to the batt by either of the usual methods, i.e. (i) radiation or convection, e.g. heating in an oven or (ii) contact heating, the blend from which the batt is made exhibits unusual and unexpected properties as will be described hereinafter.

Despite the presence of the binder fiber in the blend, when a batt of the blend is subjected to radiation or convection heating to render the binder fiber sticky while the hollow fiber remains nonsticky, the binder fiber sticks hollow fibers together without destroying the filling power advantage of hollow fiber over solid fiber. In addition, unexpectedly, batt has the property of low bulk under load, i.e. the bulk of the batt under load is as low as and sometimes less than the bulk under load of the same batt wherein the hollow fiber is replaced by the same weight of solid fiber. The "load" part of "bulk under load" is that load on the batt that reduces the original thickness of the batt by at least 75%. Accordingly, batt made of blend of the present invention exhibits a much greater bulk loss under high load than batt made of the same weight of solid polyester fiber. In summary, batt made of blend of the present invention, which has been subjected to bonding by radiation or convection heating possesses the unusual combination of properties of high filling power and low bulk under load.

Batt made of blend of the present invention can also be subjected to contact (conduction) heating such as by passing the batt through the compression zone formed between a heated roll and a conveyor belt, the heated roll heating and compressing the batt to generally no more than about 50% of its original thickness. Despite this heating and compression and attendent bonding of fibers at the surface and within the batt, the batt made from the blend of the present invention exhibits an unexpectedly high filling power as compared to batt made by the same treatment but having solid fiber instead of hollow fiber. Depending on the degree of compression, and heating time and temperature, this heat treatment can provide the batt with a bonded scrim or skin at the surface of the batt formed in situ from the hollow fibers and binder fibers at and near the surface of the batt. This bonded scrim or skin is of greater opacity (cover) and lesser porosity than obtained from the same treatment applied to the same batt except solid fibers being substituted for the hollow fibers.

BRIEF DESCRIPTION OF THE DRAWINGS

FIG. 1 shows in side elevation a batt made of a blend of the present invention, after heating by radiation or convection heating to bond the batt;

FIG. 2 shows schematically the bonded appearance of several fibers; and

FIG. 3 shows schematically in side elevation apparatus for contact heating and compressing a batt of blend of the present invention to form a bonded nonwoven scrim on a surface of the batt.

DETAILED DESCRIPTION OF THE PRESENT INVENTION

The hollow fibers of blends of the present invention are preferably prepared from terephthalate polyesters and is more preferably poly(ethylene terephthalate). The fibers can be made in hollow form by spinning filament using a postcoalescent spinneret as described in U.S. Pat. No. 3,772,137. The filaments are then drawn and crimped. The void content of the drawn filaments can vary from about 8 to about 30% by volume. This void within the filament is essentially a continuous longitudinal passage surrounded by the polymer of the filament. The preferred void content is from 10 to 20% by volume. As void content decreases from this range, the hollow fiber acts more like solid fiber, and as void content increases from this range, the batt becomes more and more subject to loss of resiliency. The drawn denier can be from 3 to 40, and is preferably from 4 to 25.

In order to obtain high bulk during carding or garnetting of blend of the present invention to form a web or batt, the hollow fibers must be crimped. Crimp levels from 3 to about 12 crimps per inch (1.2 to 4.7 crimps/cm) are suitable, with 6 to 10 cpi (2.4 to 3.9 crimps/cm) being preferred. The crimped filaments can be cut to the desired length of hollow fibers, e.g. 3.8 to 12.7 cm, and preferably about 5.1 cm. These fibers are then blended with crimped binder fibers. Preferably, however, the crimped filaments are combined with crimped binder filaments prior to cutting. The mixing resulting from cutting the combined filaments and the subsequent transfer with an air transport system to a baling station provides a fiberfill blend suitable for feed stock to cards or garnetts.

The binder fibers are prepared from polyester polymer which has a lower melting point that the polyester polymer from which the hollow fiber is made. The binder fiber preferably has a stick temperature above about 80° C and below that of the hollow fibers. Preferred binder fiber has a stick temperature between 80° and 200° C. Fiber stick temperature is measured as described by Beaman and Cramer, J. Polymer Science 21, page 228 (1956). A flat brass block is heated electrically to raise the block temperature at a slow rate. The fiber sample is suspended under slight tension between glass rods over and near the surface of the block. At intervals, the fiber is pressed against the block for 5 seconds with a 200 gram brass weight which has been in continuous contact with the heated block. The fiber stick temperature is the temperature of the block when the fiber sticks to it for at least 2 seconds after removing the weight.

A preferred binder fiber is composed of an ethylene terephthalate/isophthalate copolymer having a terephthalate/isophthalate mole ratio of about 70/30, which has a stick temperature of about 90° C. The binder fiber is crimped so that it will process easily with the hollow fiber. The crimp level of the binder fibers is not as critical as that of the hollow fiber and low crimp levels such as 2 to 6 crimps per inch may be used if desired. Preferably the crimp level of the binder fiber is about the same as that of the hollow fiber for optimum processability.

The denier of the binder fiber can also be less than that of the hollow fiber. The denier may range from as low as 1 up to about 15 with deniers of 1.5 to 10 being preferred.

The amount of binder fiber in the blend can range from 3 to 45% by weight based on the weight of the blend, and preferably from 5 to 30% by weight. As the proportion of binder fiber decreases, less and less bonding is achieved. As the proportion of binder fiber increases, the batt excessively loses bulk upon heating.

Blend of the present invention can be made into a batt such as batt 2 shown in FIG. 1 in a single layer of the blend or built up of multiple layers. Typically the batt will be formed from multiple layers of a card-formed or garnett-formed web of the blend, by crosslapping the web on a moving apron to the batt thickness desired such as disclosed in U.S. Pat. No. 3,290,704. Instead of the entire batt consisting of the blend of the present invention, the interior of the batt can be formed from crimped fiber, preferably hollow, by itself. This can be accomplished by compartmenting the feed zone to the card or garnett, feeding the blend to the feed zone which forms the edges of the web and feeding only crimped hollow fiber to the central feed zone, and controlling the apron speed so that the strips of blend in the web form the upper and lower surfaces of the batt and the crimped hollow filament forms the interior of the batt, such as disclosed in French Patent Publication No. 2,269,598 and U.S. Pat. No. 3,740,282.

After radiation or convection heating of the batt such as in an oven to a temperature above the stick temperature of the binder fiber, the binder fiber bonds adjacent hollow fibers together such as shown in FIG. 2 wherein the hollow fibers are identified as 4 and the binder fibers, contracted and somewhat globular after the heating, as bonding mass 6. The binder fiber can actually envelop the hollow fibers where they cross one another, and the binder fiber need not necessarily melt to the extent of entirely losing its fiber shape. Such a batt possesses high filling power and surprisingly low bulk under load. Preferably, the batt has a higher filling power and lower bulk under load than does the same batt, but with the same weight of solid fibers substituted for the hollow fibers.

In FIG. 3, a batt 20 of blend of the present invention is fed downwardly into a space between a heated roll 22 and a conveyor belt 24 trained around rolls 26, 28 and 30. The roll and the belt move at the same surface speed to convey the batt through the space. The space is narrower than the thickness of the batt so that the batt is compressed in the space up to about 50% of the original batt thickness. Therefore, while being conveyed through the space, the batt is contact heated and relatively slightly compressed, which has the effect of forming a dense skin 32 on the batt (upper) surface in contact with roll 22. This is surprising in view of the relatively small proportion of binder fiber present at the batt surface and the relatively slight compression of the batt. The force of the roll 22 on the upper surface of the batt is in effect only opposed by the resistance to further compression of the body (remaining 50% or more) of the batt. Since the batt is loose and fluffy, this resistance is very little. The skin 32 is like a bonded nonwoven scrim which is sufficiently dense to be somewhat opaque and to have low porosity. The scrim is practically paper thin, e.g. less than 0.05 cm in thickness, relative to the overall thickness of the batt. Generally, the batt (no load) will be at least ten times the thickness of the scrim at either surface of the batt. The high opacity and low porosity of the scrim serves the purpose of minimizing fiber escape from the surface of the batt. The ability of the blend to provide this scrim is unexpected when it is realized that the pressure on the batt is very low, i.e. the opposing force compacting the surface of the batt is only the fluffy interior of the batt. Upon emergence from the space between the hot roll and conveyor belt, the batt expands in thickness generally to at least about 75% of its original thickness.

The no-load bulk of batt made by this contact heating/compression technique is unexpectedly greater, than the bulk of batt made the same way except for substituting an equal weight of solid fiber for the hollow fiber. In U.S. Pat. No. 3,772,137, the no-load bulk improvement obtained from the hollow fibers with no binder fiber present is no more than about 5% (Table 1A) while in the present invention, the no-load bulk improvement is at least 10% (Table I).

Batt formed from the blend of the present invention by either type of heating is fluffy at least in the interior of the batt and usually has a basis weight of 1.5 to 40 oz/yd$^2$ and preferably 4.5 to 20 oz/yd$^2$ and a density of less than 0.05 g/cc and preferably less than 0.01 g/cc.

In addition to garment utility, the blend can be used to make fiberfill for other applications such as household use, e.g. quilts, pillows, furniture upholstering and sleeping bags.

Representative examples of the present invention are as follows (parts and percents are by weight based on total weight unless otherwise specified):

In the following examples, blends of polyester fibers and copolyester binder fibers are prepared by weighing out appropriate weights of the fibers and mixing them by hand to give the desired weights based on total weight.

The hollow polyester fibers are prepared from poly(ethylene terephthalate) and have a void content of about 15%, a drawn denier of 5.5, about 3.1 crimps per cm and a cut length of 5.1 cm.

The copolyester binder fibers are prepared from an ethylene terephthalate/isophthalate copolymer having a terephthalate/isophthalate mole ratio of 70/30 and a stick temperature of about 90° C. The binder fibers have a drawn denier of 5, about 2.4 crimps per cm and a cut length of 5.1 cm.

The solid poly(ethylene terephthalate) fibers have a drawn denier of 6.0, about 3.1 crimps per cm and a cut length of 5.1 cm.

EXAMPLE 1

A 152 cm wide feed hopper of a garnett is modified by placing 2 vertical partitions 30.5 centimeters from each side to provide 3 feed zones. The center feed zone of the hopper is fed with crimped hollow poly(ethylene terephthalate) staple fibers having a cured coating of a polysiloxane and a drawn denier of 5.5. The two end feed zones are fed with a blend of 75 percent, by weight crimped hollow poly(ethylene terephthalate) staple fibers, and 25 percent crimped binder fibers. The garnett produces a web 152 cm wide having three bands and a weight of 20.8 gm/m$^2$. The center band contains the coated fibers and is 91.5 cm wide and the two outer bands contain the blend, and each band is 30.5 cm wide. The web is passed to a crosslapper and deposited on a horizontal conveyor moving at an angle of 90° to the direction of the crosslapper to produce a batt 116.8 cm wide and 12.7 cm thick. The batt has a center layer of coated fibers about 7.6 cm thick between top and bottom layers about 2.5 cm thick. The batt is surface bonded by contact with a roll heated to 170° C. The batt is heated under a light contact pressure resulting from compressing the batt to about 60% of its original thickness of the batt to compact the surface in contact with the roll to form a thin fused scrim. The contact time over the roll is about 8 to 10 seconds. After bonding this surface, the batt contacts another heated roll and the other surface is bonded in the same manner. The bonded batt has scrim surfaces which are more opaque and less porous than those obtained with solid fibers and it can be handled much more easily than the nonbonded batt, and the desired bulk and softness are retained.

EXAMPLE 2

A blend of fibers containing 87.5% by weight hollow fibers and 12.5% binder fibers is fed to a card to produce a web and the web cross-lapped to produce a batt. This batt is identified as Batt A. A second batt is produced in a similar manner except that the hollow fibers are replaced with the same weight of solid fibers. This batt is identified as Batt B.

A blend of fibers is produced containing 75% hollow fibers and 25% binder fibers and is fed to the two end feed zones as described in Example 1 and the center section is fed with hollow fibers. The batt that is produced is identified as Batt C. Batt D is prepared in the same manner except that the hollow fibers are replaced with the same weight of solid fibers.

The batts are then surface bonded as described in Example 1 except that a roll temperature of 210° C is used for the first pass and a roll temperature of 180° C is used for the second pass to form a scrim on each surface of the batt, the scrim of Batts A and C having greater cover and less porosity than the scrim of Batts B and D.

Bulk values for Batts A to D are obtained by cutting 30.5 × 30.5-cm squares from the surface-bonded batts to a total of about 145 g, weighing the squares, stacking the squares, and determining the height of the stacked squares under the load applied using an Instron Tester equipped with a presser foot 10.2 cm in diameter. The height of the batt is an indication of its bulk. The results are shown in Table I.

TABLE I

| | | Bulk Height in cm for 145 grams Batt - 929cm$^2$ | | | | |
|---|---|---|---|---|---|---|
| Batt | Fiber Type | No-load height | .010 kg/cm$^2$ | .022 kg/cm$^2$ | .045 kg/cm$^2$ | .090 kg/cm$^2$ |
| A | Hollow | 22.9 | 11.7 | 8.4 | 5.1 | 2.8 |
| B | Solid | 20.3 | 9.7 | 6.6 | 3.8 | 2.0 |
| C | Hollow | 22.3 | 11.7 | 8.4 | 5.1 | 2.8 |
| D | Solid | 17.5 | 8.4 | 5.8 | 3.6 | 2.0 |

These results show an unexpectedly higher bulk for batt made of blend of the present invention.

EXAMPLE 3

Batts similar to those described in Example 2 are prepared and identified as Batts E to H. Batt E contains 87.5% solid fibers and 12.5% binder fibers; Batt F contains 87.5% hollow fibers and 12.5% binder fibers; Batt G has a center layer of solid fibers and surface layers of the 75/25 wt % solid fiber/binder fiber blend; and Batt H has a center layer of hollow fibers and surface layers of the 75/25 wt % hollow fiber/binder fiber blend.

The batts are heated in an oven at 193° C for 4 minutes.

Bulk values for Batts E to H are obtained by cutting 38.1 × 38.1 cm squares from the heated batts to total about 340 grams, weighing the squares, stacking the squares (about 6 squares) and measuring the height of the stacked squares and correcting the height, if necessary, for weights different than 340 grams; this height is recorded as the no-load height. Weights are added to the stacked squares to provide, successively, 0.0011, 0.007 and 0.014 kilogram/centimeter$^2$ and the height of the stacked squares is measured after each loading. Results are shown in Table II.

TABLE II

| Batt | Fiber Type, No-load height(cm) | | .0011 kg/cm$^2$ | .007 | .014 |
|---|---|---|---|---|---|
| E | solid | 60.0 | 43.7 | 24.9 | 16.0 |
| F | hollow | 62.2 | 45.2 | 26.2 | 14.7 |
| G | solid | 68.8 | 46.0 | 24.9 | 14.7 |
| H | hollow | 73.1 | 48.8 | 25.9 | 14.4 |

These results show the unexpected greater decrease in bulk for batt made of blend of the present invention under a load which reduces the batt thickness by at least 75%.

The bonded batts made from blends of the present invention, such as described in the foregoing Examples, are sufficiently handleable as such without requiring a separate support fabric.

What is claimed is:

1. A fiberfill blend for making into a batt for heat bonding of said batt to make the fiberfill especially suitable for garments, said blend consisting essentially of from 55 to 97% by weight of crimped hollow polyester fiber having a void content of from 8 to 30% by volume and, complementally to total 100%, 3 to 45% by weight of crimped binder fibers of a lower melting polyester than said hollow polyester fiber, said blend possessing properties for providing batts having, as compared to batts provided from a blend which is the same except that the same weight of solid polyester fiber has been substituted for the hollow polyester fiber in the blend: (a) higher filling power but at least as low bulk under load when heat bonded by convection or radiation heating, and (b) higher filling power and a surface formable into a higher cover, less porous bonded skin by contact heating of said surface accompanied by compressing said batt during said heating no more than 50% of the original thickness of said batt.

2. The blend of claim 1 containing 5 to 30% by weight of said binder fibers.

3. A batt of the blend of claim 1 at least at the surface of said batt bonded by convection or radiation heating.

4. A batt of the blend of claim 1 at least at the surface of said batt bonded by contact heating to form said scrim skin at least at one surface of said batt.

* * * * *

UNITED STATES PATENT OFFICE

CERTIFICATE OF CORRECTION

PATENT NO. : 4,129,675

DATED : 12/12/78

INVENTOR(S) : Paul T. Scott

It is certified that error appears in the above-identified patent and that said Letters Patent are hereby corrected as shown below:

Column 8, line 9; "scrim" should be deleted

Signed and Sealed this

*Twenty-fifth* Day of *September 1979*

[SEAL]

*Attest:*

*Attesting Officer*

LUTRELLE F. PARKER

*Acting Commissioner of Patents and Trademarks*